US005580260A

United States Patent [19]

Flieger et al.

[11] Patent Number: 5,580,260

[45] Date of Patent: Dec. 3, 1996

[54] PLUG-TYPE CONNECTOR

[75] Inventors: Richard Flieger, Stammham, Germany; Freddy D'Hulster, Aartrijke; Rony Van Houdenhove, Ruiselede, both of Belgium

[73] Assignee: Siemens Aktiengesellschaft, Munich, Germany

[21] Appl. No.: 313,862

[22] Filed: Sep. 28, 1994

[30] Foreign Application Priority Data

Sep. 28, 1993 [DE] Germany ..... 9314667 U

[51] Int. Cl.[6] ..... H01R 29/00

[52] U.S. Cl. ..... 439/188; 439/620

[58] Field of Search ..... 439/188, 620, 439/701

[56] References Cited

U.S. PATENT DOCUMENTS

| | | | |
|---|---|---|---|
| 4,685,887 | 8/1987 | Hanning | 439/188 |
| 4,786,258 | 11/1988 | Shaffer et al. | 439/188 |
| 5,108,300 | 4/1992 | Weber | 439/620 X |
| 5,139,442 | 8/1992 | Sakamoto et al. | 439/620 |
| 5,310,362 | 5/1994 | Bauerle et al. | 439/620 |
| 5,340,325 | 8/1994 | Pai | 439/620 X |
| 5,382,173 | 1/1995 | Brown et al. | 439/620 X |

FOREIGN PATENT DOCUMENTS 9112718 8/1992 Germany .

*Primary Examiner*—Khiem Nguyen
*Attorney, Agent, or Firm*—Hill, Steadman & Simpson

[57] ABSTRACT

A connector is provided having a pin plug with a plurality of first socket contacts for connection to system wires. The connector also has a mated socket plug with a plurality of second socket contacts for connection to system wires. The pin plug and socket plug can be coupled together for connecting the first and second socket contacts with pins secured in the pin plug. A short-circuit bridge is integrated in the socket plug for short-circuiting two of the second contacts when the pin plug and socket plug are uncoupled. An electrical filter component is integrated in the pin plug, the filter component being connected in series between one of the first socket contacts and a respective second socket contact upon coupling.

19 Claims, 6 Drawing Sheets

PLUG-TYPE CONNECTOR

BACKGROUND OF THE INVENTION

The present invention generally relates to mated plug-in-socket type electrical connectors. More specifically, the present invention relates to such connectors which protect against transmission of erroneous signals caused, for instance, by static electricity.

Plug-type connectors are generally known. Known connectors have a socket plug and a pin plug which mate to form a coupled plug pair. Both the socket plug and the pin plug are generally made of insulator material. Both the pin plug and socket plug have receptacles for receiving, protecting and securing respective socket contacts. The pin plug has a set of conductive pins secured therein which are received by the corresponding socket contacts in the socket plug.

Plug-type connectors are known to have a resilient short-circuit bridge for connecting two internal connector contacts together during an uncoupled condition. To undo this short-circuit upon coupling, an associated pin plug is provided with a circuit-breaker element for each short-circuit bridge. The circuit-breaker element cancels the short-circuit between the respective socket contacts when the socket plug and pin plug are coupled. Such a plug-type connector is disclosed by German utility model 91 12 178.

Plug-type connectors are utilized, for example, in airbag systems in motor vehicles. Increasing demands on the operating reliability of such systems results in increased demands on their plug-type connectors. In addition to the conventional function of producing a releasable electrical connection, such plug-type connectors must also protect against airbag system malfunctions. For example, static electricity can create a voltage across parts of an airbag control circuit and cause an accidental deployment of an airbag. Also, spurious electromagnetic disturbances can cause such a release during operation of an automobile.

Electrostatic charges are problematic during assembly or maintenance operations on a motor vehicle. In order to avoid having individual discharge sparks result in a spurious deployment of an airbag, a power supply contact of the socket plug in an uncoupled plug-type connector is short-circuited with a low-impedance ground contact. Erroneous airbag releases are consequently prevented by diverting static electricity discharges via the ground contact.

In German utility model 91 12 178, mentioned above, a socket plug is disclosed which includes a resilient element that causes a short-circuit in an unplugged condition. This short-circuit is reliably opened, by a tongue-shaped circuit-breaker when the pin plug is coupled in the plugged condition. The circuit-breaker includes a tongue-shaped element on the pin plug configured for insertion between socket contacts and the short-circuit element when the pin plug and socket plug are coupled.

As mentioned above, spurious airbag deployment can also be caused by line-conducted, high-frequency voltages which can result from electromagnetic disturbances. Such malfunctions can occur during operation of a motor vehicle, i.e., with the plug-connector coupled, particularly within a few milliseconds of the ignition process.

To protect against airbag deployment from this sort of electrical disturbance, it is known to incorporate a second, additional plug-type connector that contains a series-connected filter component. Such a filter component has conventionally been installed during the assembly of an automobile by a soldered connection adjacent the gas-generator components of an airbag system.

Therefore, a need exists for a plug-type connector that can protect against line disturbances caused by both static charges and high-frequency noise. A further need exists for such a connector which is compact and easy to assemble.

SUMMARY OF THE INVENTION

The present invention provides a plug-type connector-coupling which is improved over prior art connector-couplings. The connector according to the present invention provides reliable coupling with grounding and filter protection against electrical charges.

To this end, an electrical filter component is integrated in the pin plug and is connected in series between two socket contacts of the plug pair that are joined to one another upon coupling.

In an embodiment, a connector is provided having a pin plug with first socket contacts and a socket plug with second socket contacts. The socket plug is matable in a coupled condition with the pin plug to form a plug pair to conductively connect the first and second socket contacts. At least one resilient short-circuit bridge is provided for short-circuiting two of the second socket contacts when the pin plug is not coupled with said socket plug. A circuit-breaker element extends from the pin plug for engaging each short-circuit bridge. The circuit-breaker element cancels a short-circuit between the respective two socket contacts in the coupled condition. A plurality of contact pins are arranged in at least one row, the pins being secured in the pin plug and connected to the first socket contacts. The contact pins are configured to be received by respective second contacts in the coupled condition. Furthermore, a component is disposed in the pin plug which is connectable in series between one first socket contact and a respective second socket contact in the coupled condition.

In an embodiment, the plurality of contact pins includes a plurality of straight contact pins. Also, the plurality of contact pins includes a pair of angled contact pins. Each angled contact pin has a pin portion and an angled portion. The angled pins are aligned 180° opposite each other so that the respective pin portions are oppositely directed. Each angled portion is connected to an end of the component so that the pin portions are laterally offset from each other and arranged in a row with the straight contact pins. In an embodiment, the pin plug is shaped generally In an embodiment, the pin plug is shaped generally cylindrically. The pin plug also has a face side at one end of the pin plug. The face side has an opening configured to receive the socket plug during coupling. The pin plug has a cable outlet side at an end opposite the face side. A first chamber is shaped generally half-cylindrically near the cable outlet side for receiving the component. The pin plug has a second chamber shaped generally half-cylindrically near said cable outlet side for housing said first contacts. A first closure cover is provided for closing the first chamber. A second closure cover is provided for closing the second chamber.

In an embodiment, the first chamber has a trough-like portion configured to receive the filter component therein. At least one spring tab extends from the inside of the first closure cover for resiliently holding the component.

In an embodiment, the socket plug includes a socket contact housing and a cover cap in which the socket housing is insertable in polarized fashion. The socket contact housing retains the second socket contacts and each short-circuit bridge therein. A closure plate is axially slidable onto the cover cap to secure the socket contact housing within the cover cap.

In a related embodiment, guide channels are provided in the socket contact housing. Guide ribs are provided on the cover cap engageable with the guide channels upon insertion of the socket contact housing into the cover cap, whereby the socket contacts are also thereby secured.

In an embodiment, a cross web is integral to the second closure cover. The cross web is arranged for securing the first contacts in the pin plug.

In an embodiment, the component is a coil.

Therefore, it is an advantage of the present invention to provide a connector that is more compact than conventional connectors.

Another advantage of the present invention is to provide a connector that is more flexible than conventional connectors.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
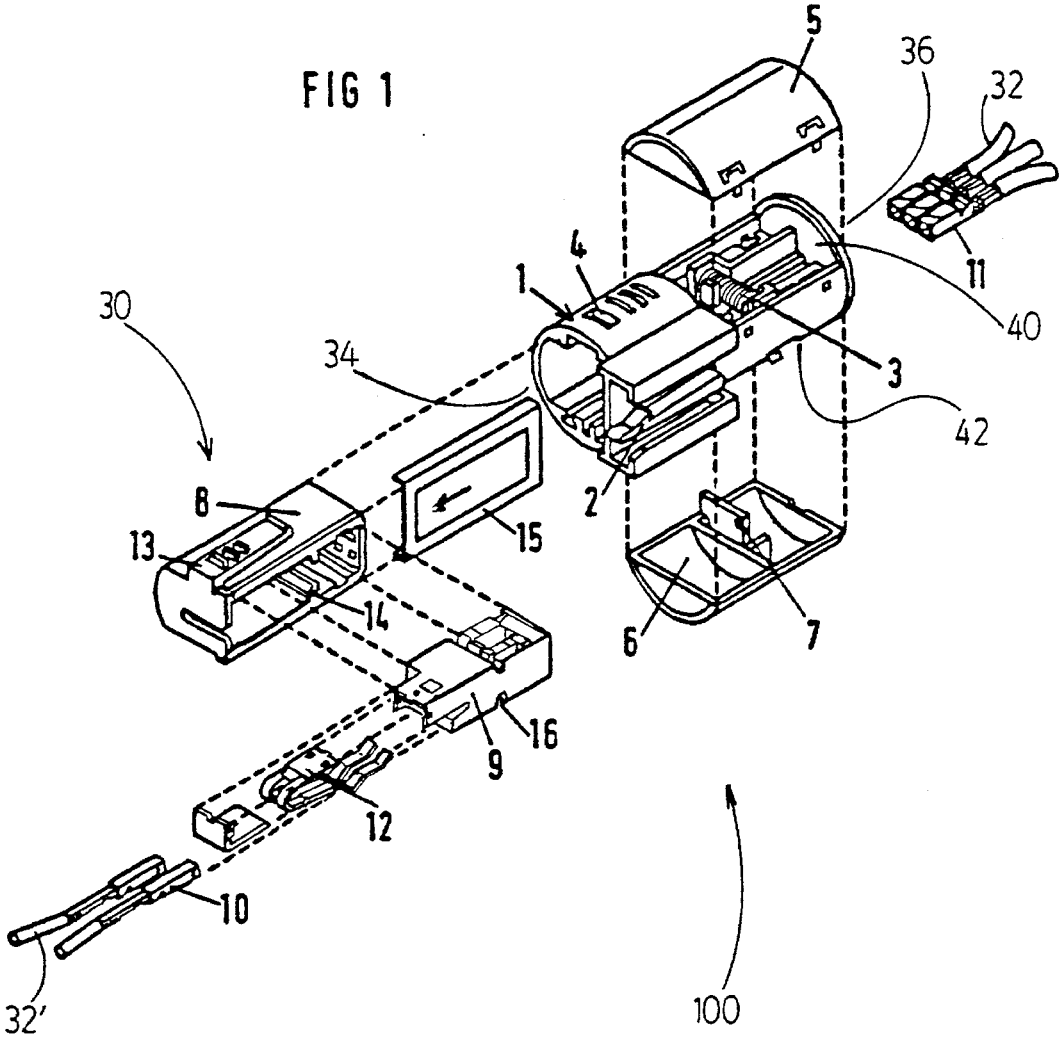
FIG. 1 is an exploded perspective view of a plug-type connector according an embodiment of the present invention.

In accordance with the invention described wherein like numerals designate like parts, a plug-type connector 100 is provided as illustrated in FIG. 1. The connector 100 can be used for connecting system wiring 32, 32' of an airbag system of an automobile.

The connector 100 has two mated coupling section s-a pin plug 1 and a socket plug 30. The pin plug 1 has a plurality of contact pins 21, 22, 23 (FIG. 3) held by the pin plug 1 in direction parallel to the plug-in mating connection between the pin plug 1 and the socket plug 30.

The pin plug 1 can have six pins arranged in two rows. However, in the illustrated embodiment, three pins 21, 22, 23 (FIG. 3) are arranged in a single row. The pin plug 1 has a face side 34 directed toward the socket plug 30. The pin plug 1 also has a cable outlet side 36 at an end opposite the face side 34. The face side 34 has an opening configured to at least partially receive the socket plug 30 during coupling.

When the pin plug 1 and socket plug 30 pushed together, the connector 100 is secured in a coupled manner by a guide and catch means, as illustrated in FIG. 1, particularly, a resilient catch hook 13 disposed along a top of the socket plug 30 and a cooperative catch opening 4 in the pin plug 1. Furthermore, snap-in hooks 2 can be provided for securing the connector 100 to, for example, a vehicle chassis (not shown).

In the embodiment illustrated, the pin plug 1 is configured generally cylindrically. Toward the cable outlet side 36, the pin plug 1 has a first chamber 40 and second chamber 42, each generally shaped as a half-cylinder. The first chamber 40 is closable by a first closure cover 5, and the second chamber 42 is closeable by a second closure cover 6.

Figure 2:
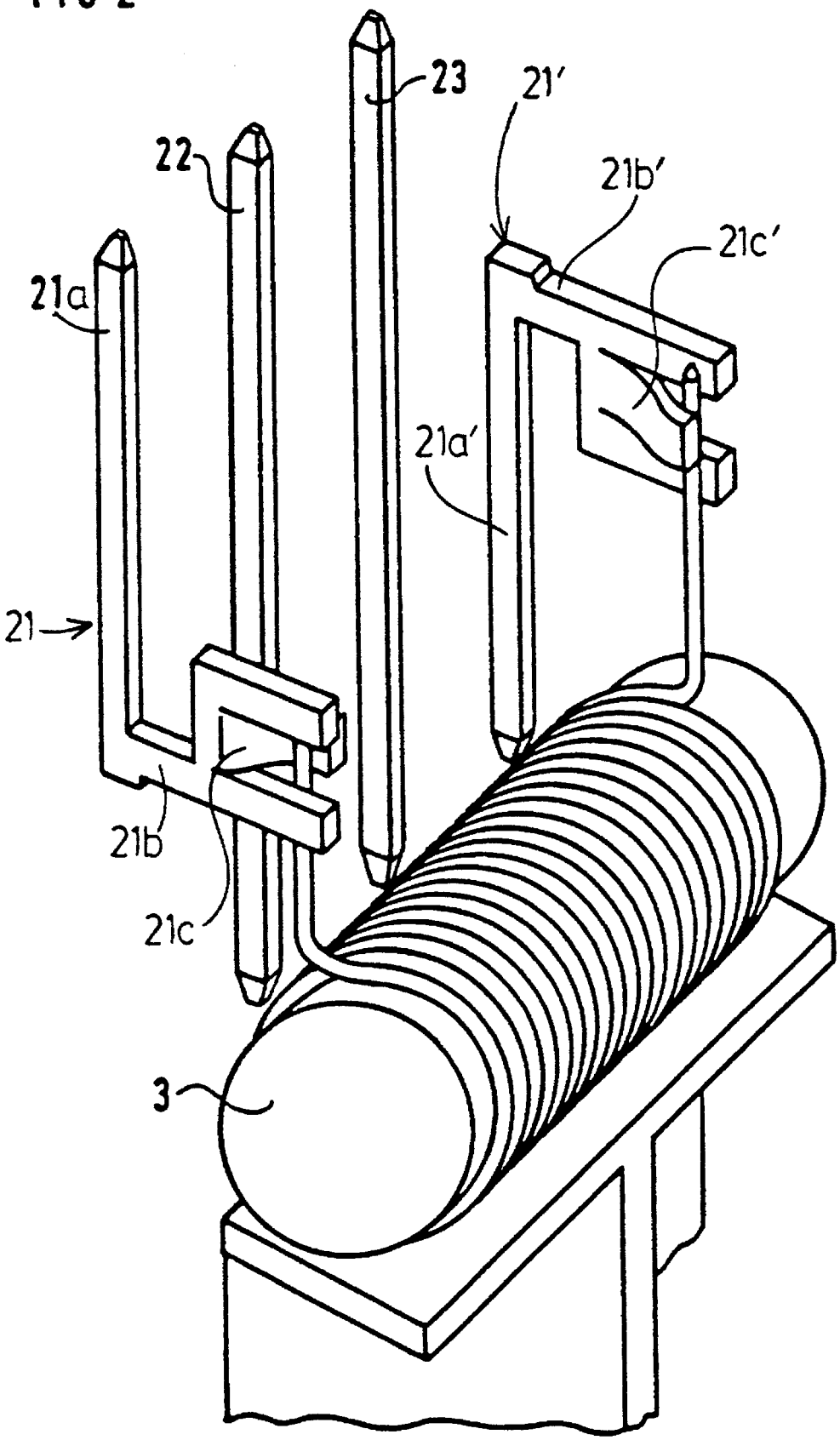
FIG. 2 is a perspective view of a series circuit filter component according to the present invention.

The first chamber 40 has a trough-like portion 44 configured to receive an electrical filter component such as a coil 3 (FIG. 2). The second chamber 42 is configured to receive and retain first socket contacts 11 which provide a connection between system wiring 32 and the contact pins 21, 22, 23. The coil 3 is preferably provided series connected as a low-pass filter. However, some other component, for example a capacitor or a wire, could be used instead.

FIG. 2 illustrates the filter coil 3 and contact pins 21, 21', 22 and 23. Two angled contact pins 21 and 21' are provided and can be configured as mirrored or identical components. Each angled contact pin 21 and 21', is angled in shape, having a pin portion 21*a*, 21*a'* and an angled portion 21*b*,21*b'*, respectively. The angled portions 21*b* and 21*b'* each have tines 21*c* and 21*c'*, respectively, which deflect to grip respective ends of the filter coil 3, forming an electrical connection thereto. The pin portions 21*a* and 21*a'* of angled pins 21 and 21' are aligned in opposite directions (rotated 180° from each other) and are disposed at laterally opposite sides of the pin plug 1.

The contact pins 22 and 23 are straight and are positioned between the contact pins 21 and 21' to form a row therewith. Preferably, the pins 22 and 23 and the pin portions of the angled pins 21 and 21' each have a cross section of approximately 0.63×0.63 mm with a gold-plated contact surface.

Figure 4:
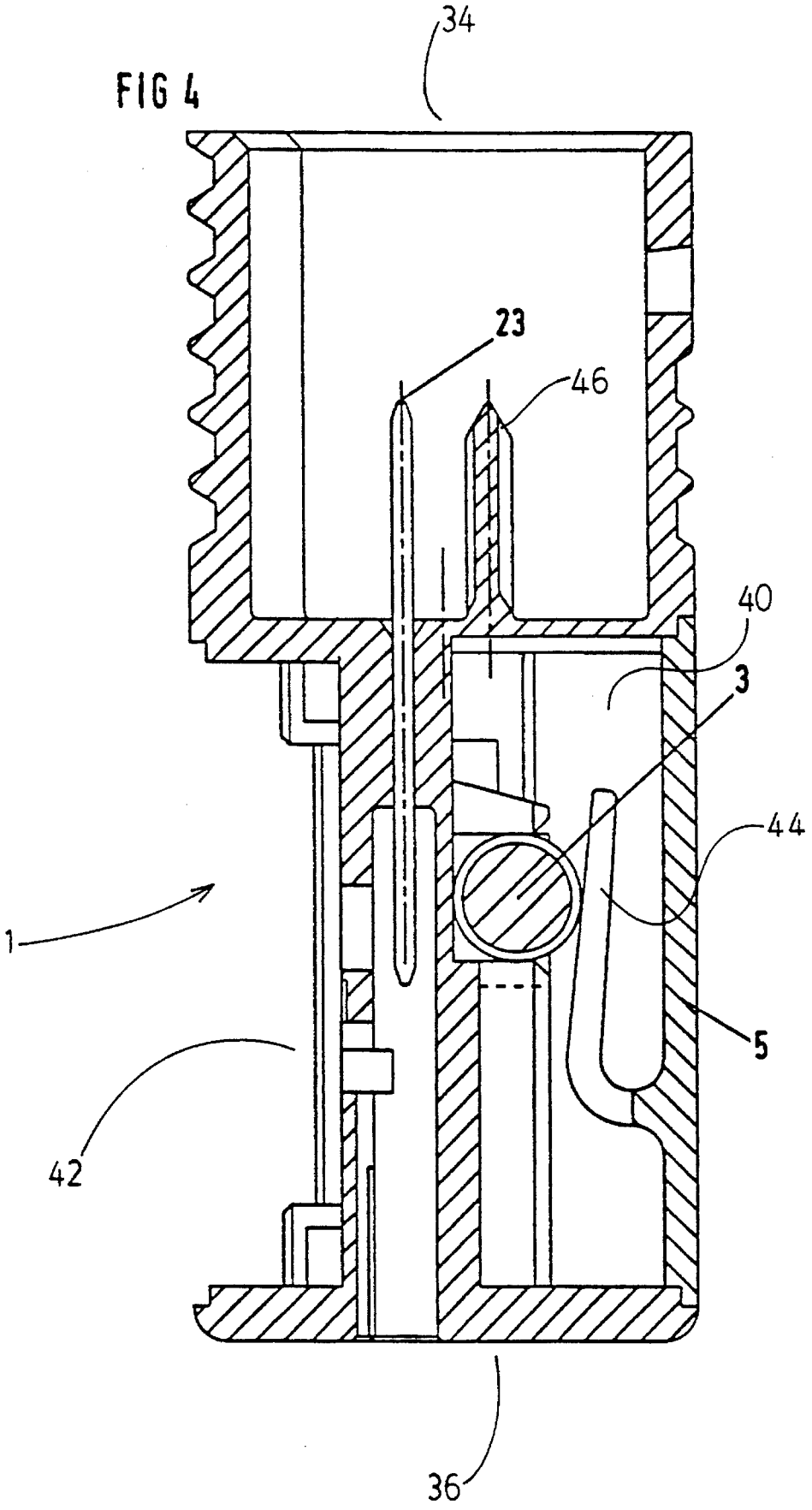
FIG. 4 is a sectional side view taken generally along line IV-IV of FIG. 3.

As can be seen from FIG. 4, the second chamber of the pin plug 1 houses the first socket contacts 11 which are connected to the contact pins 21', 22 and 23, also disposed therein. The first socket contacts 11 can have a catch sleeve to be received in the pin plug 1 with spring tabs.

Figure 3:
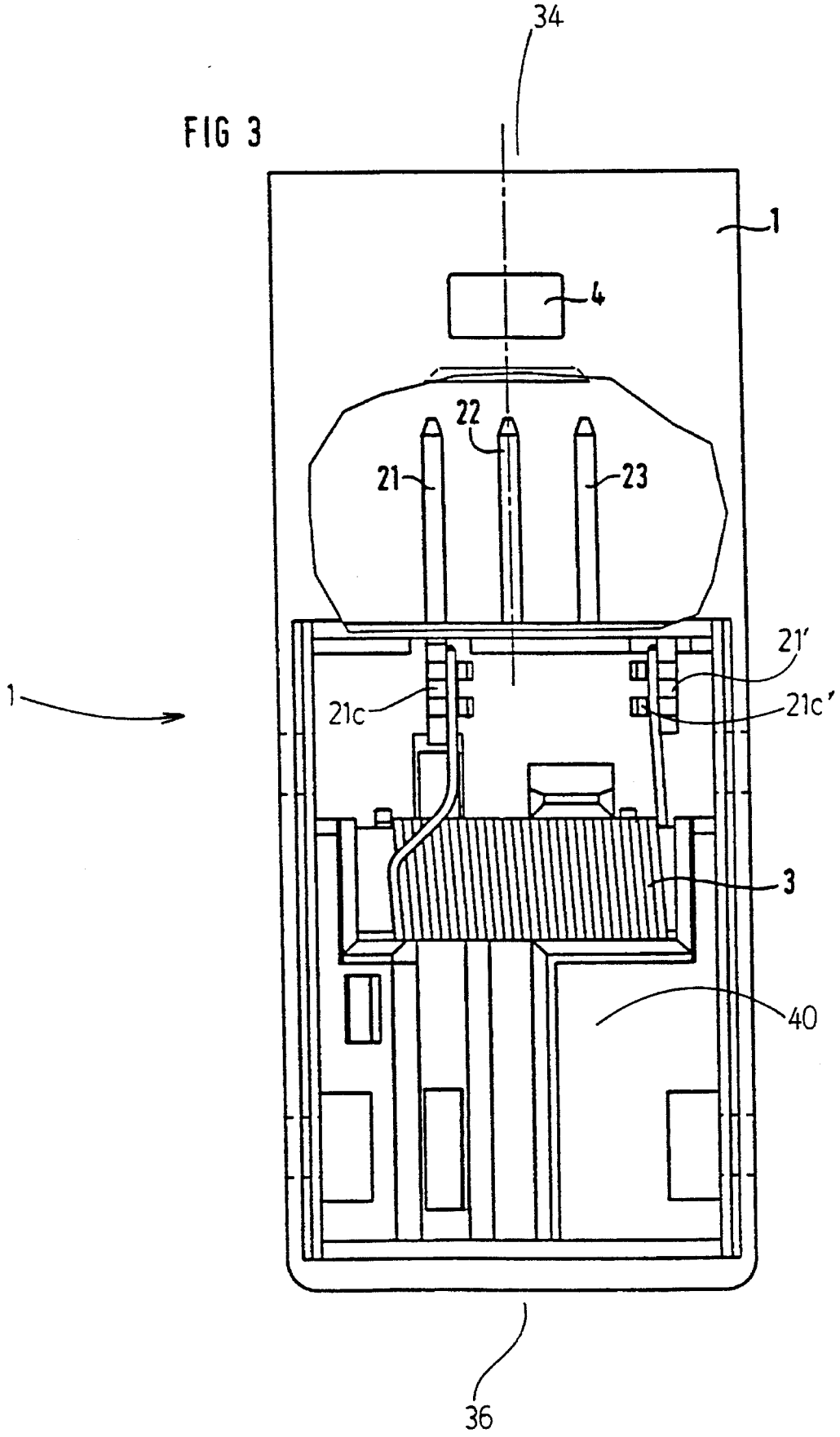
FIG. 3 is a plan view onto an unclosed pin plug.

As illustrated in FIG. 3, the pins 21, 22 and 23 are secured in the pin plug 1 in a parallel manner. The pins 21, 22 and 23 extend axially toward the socket plug 30 to be received by corresponding second socket contacts 10 therein. The second socket contacts 10 are connectable to system wiring 32'.

Figure 5:
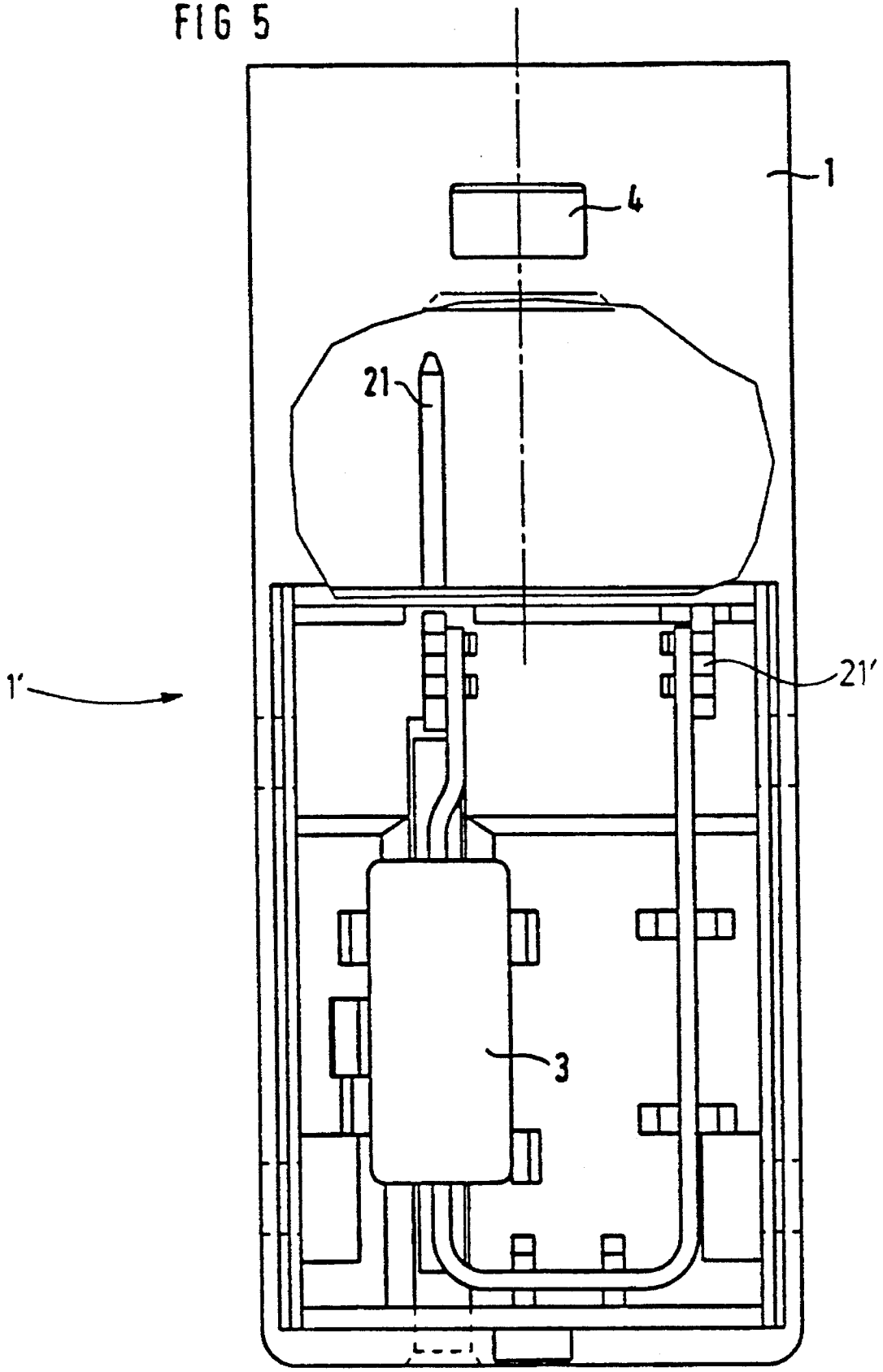
FIG. 5 is a plan view of another embodiment of a pin plug of the invention.

In an alternative embodiment, as illustrated in FIG. 5, a coil 3' can be arranged transversely to the axial direction of the pin plug 1. Moreover, the coil 3 or 3' can also be encased in plastic.

So that coils having standard dimensions can withstand high vibrational accelerations (10 G and more) without damage, the first chamber has a recess for receiving the coil 3. The coil 3 is held therein by at least one resilient spring tab 44 extending from the cover 5, as shown in FIG. 4. The first closure cover 5 is provided with catch hooks to snap into a closed position and press the coil 3 into the first chamber 40. The first closure cover 5 stays closed unless snapped open with a reverse force. Vibrations are adequately damped by the spring tab 44 pressing against the coil 3.

The secondary interlock prescribed for safety reasons is preferably performed by a cross web 7 integrally extending from the inside of the second closure cover 6 for securing the first socket contacts 11 when the second closure cover 6 is closed. The second closure cover 6 is preferably pivotable on a hinge. The second closure cover 6 engages via a catch hook snap-fit mechanism, which can be injection molded. The closure cover 6 can be opened again for accessing the second chamber 42.

As shown in FIG. 1, the socket plug 30 includes as a socket contact housing 9 insertable in a polarized fashion into a cover cap 8. The second socket contacts 10 and a short-circuit bridge 12 (FIG. 6) are arranged within the socket contact housing 9. The socket plug 30 further has a closure plate 15 that can be axially slipped over the cover cap 8 to retain the socket contact housing 9 therein.

The socket contact housing 9 is provided with guide channels 16 engageable upon insertion with corresponding guide ribs 14 integral to the cover cap 8. The second socket contacts 10 are thereby secured. Moreover, catch noses are provided on the cover cap 8 for fitting into corresponding depressions in the closure plate 15, preventing incorrect assembly due to a closed channel in the cover cap 8.

Beyond a fundamental advantage of the invention of providing a series circuit integrated in a single plug-type connector with a short-circuit element, this embodiment of the series circuit provides an additional advantage in that the two contact pin parts 21 can mirror each other or identical and asymmetrically mounted. This particularly enables an easy installation in two identical steps.

The two contact pins 22 and 23, each have respective ends 22*a* and 23*a* respectively connected to the first socket contacts 11. Opposite ends 22*b* and 23*b* of pins 22 and 23, respectively, are configured to be received in the second socket contacts 10 disposed within the socket plug 30 when the socket plug 30 and pin plug 1 are coupled together.

The first and second socket contacts 10 and 11 connected to one another by the two contact pin parts 21, 21' and by the series-connected coil 3 are somewhat laterally offset; this substantially increases the latitude for the arrangement of the coil 3 or of some other filter component. In the illustrated embodiment, one of the pins 22 or 23 serves neither as a power supply terminal nor as a ground terminal but as a facultative connecting pins.

Figure 6:
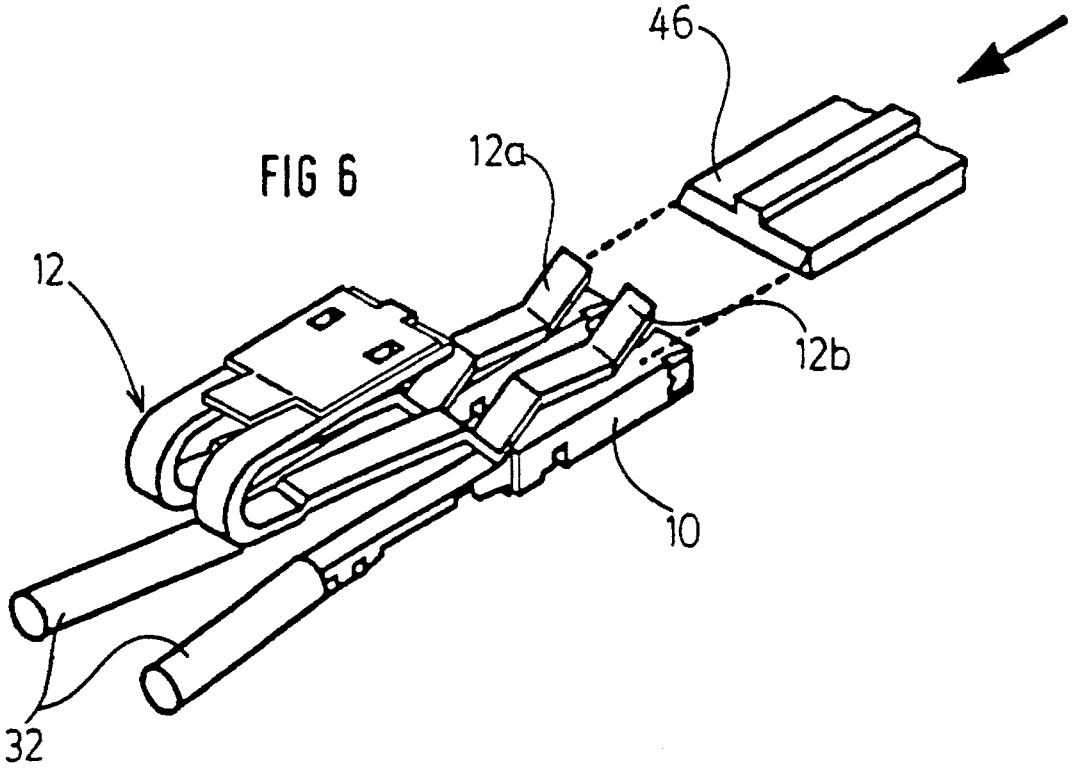
FIG. 6 is a perspective view of a short-circuit bridge according to the present invention.

As illustrated in FIG. 6, the short-circuit bridge 12 has two resilient parallel prongs 12*a*, 12*b*, each being biased to contact against respective second socket contacts 10. The short-circuit bridge is conductive, and when in contact, the prongs 12*a*, 12*b* effectively short-circuit the two second socket contacts 10.

The short-circuit between second socket contacts 10 is only desired during an uncoupled condition. A circuit-breaker element, such as a tongue 46, is provided which extends axially from the pin plug 1 (see also FIG. 4) for undoing the short-circuit upon plugging the socket plug 30 and pin plug 1 together. The tongue 46 is arranged to slide between each prong 12*a*, 12*b* and the respective second socket contact 10 upon plugging together, deflecting the prongs 12*a*, 12*b*. The tongue 46 is made of insulating material, breaking the short-circuit during a plugged condition. One of the contact paths shorted in the socket plug 30 is usually associated with the series circuit.

It should be understood that various changes and modifications to the presently preferred embodiments described herein will be apparent to those skilled in the art. Such changes and modifications may be made without departing from the spirit and scope of the present invention and without diminishing its attendant advantages. For example, more than one short-circuit bridge can be provided. Furthermore, more socket contacts, pins, and associated system wires can be provided as necessary for a particular application than discussed herein for the exemplary embodiments. It is, therefore, intended that such changes and modifications be covered by the appended claims.

What is claimed is:

1. An electrical connector comprising:

a pin plug having first electrically conductive socket contacts;

a socket plug having second electrically conductive socket contacts, said socket plug being matable in a coupled condition with said pin plug to form a plug pair to conductively connect said first and second socket contacts;

at least one resilient short-circuit bridge which short-circuits two of said second socket contacts when said pin plug is not coupled with said socket plug;

a circuit-breaker element extending from said pin plug engaging said at least one short-circuit bridge, said circuit-breaker element canceling said short-circuit between said two socket contacts in said coupled condition;

a plurality of electrically conductive contact pins arranged in at least one row secured in said pin plug and connected to said first socket contacts, said contact pins configured to be received by respective ones of second socket contacts in said coupled condition; and an electrically conductive filter component disposed in said pin plug connectable in series between one of said first socket contacts and one of said respective second socket contact in said coupled condition of said plug pair.

2. The electrical connector according to claim 1 wherein the plurality of contact pins comprises:

a plurality of straight contact pins; and pair of angled contact pins, each angled contact pin having a pin portion and an angled portion, said angled pins being aligned 180° opposite each other so that said respective pin portions are oppositely directed, each angled portion being connected to an end of said component so that said pin portions are laterally offset from each other and arranged in a row with said straight contact pins.

3. The electrical connector according to claim 1 wherein said pin plug is shaped generally cylindrically, said pin plug comprising:

a face side at one end of said pin plug, said face side having an opening configured to receive said socket plug during coupling;

a cable outlet side at an end opposite said face side;

a first chamber shaped generally half-cylindrically near said cable outlet side which receives said component;

a second chamber shaped generally half-cylindrically near said cable outlet side, said second chamber housing said first sockets contacts;

a first closure cover closable over said first chamber; and a second closure cover closable over said second chamber.

4. The electrical connector according to claim 3 further comprising:

a trough-like portion in said first chamber, said trough-like portion configured to receive said filter component therein;

at least one spring tab extending from the inside of said first closure cover, said spring tab for resiliently holding said component.

5. The electrical connector according to claim 1 wherein said socket plug comprises:

a socket contact housing;

a cover cap in which said socket housing is insertable in a polarized fashion, said cover cap retaining said second socket contacts and each short-circuit bridge; and a closure plate axially slidable onto said cover cap to securing said socket contact housing within said cover cap.

6. The electrical connector according to claim 5 further comprising:

guide channels in said socket contact housing; and guide ribs on said cover cap engageable with said guide channels upon insertion of said socket contact housing into said cover cap, whereby said socket contacts are also thereby secured.

7. The electrical connector according to claim 3 further comprising:

a cross web integral to said second closure cover, said cross web securing said first sockets contacts in said pin plug when said second closure cover is closed.

8. The electrical connector according to claim 1 wherein said component is a filter coil.

9. An electrical connector comprising:

a pin plug with a plurality of electrically conductive first socket contacts connectable to system wires;

a socket plug with a plurality of electrically conductive second socket contacts connectable to system wires, said socket plug being coupleable with said pin plug to connect said first and second socket contacts;

a short-circuit bridge disposed in the socket plug causing a short-circuit between two of said second socket contacts when said pin plug and socket plug are uncoupled;

an electrical filter component disposed within the pin plug, the filter component being connected in series between one of said first socket contacts and one of said respective second socket contacts upon coupling;

two straight pins to connect two said first contacts with two respective second socket contacts;

a first angled pin to connect a first end of said filter component to one of said first socket contacts; and a second angled pin to connect a second end of said filter component to one of said second socket contacts.

10. The electrical connector according to claim 9 further comprising:

a circuit-breaker element disposed on said pin plug which cancels said short-circuit when said pin plug and socket plug are coupled.

11. The electrical connector according to claim 9 wherein said filter component is a coil.

12. The electrical connector according to claim 9 wherein said pin plug comprises:

a first chamber which holds said filter component; and a second chamber which holds said first socket contacts.

13. The electrical connector according to claim 9 wherein the first and second angled pins are like parts being laterally offset and oppositely aligned within the pin plug.

14. The electrical connector according to claim 9 wherein said short-circuit bridge has two resilient prongs, each said prong being biased to contact against one of said second socket contacts.

15. The electrical connector according to claim 9 wherein said socket plug comprises:

a socket contact housing which retains said second,socket contacts and each short-circuit bridge;

a cover cap in which said socket housing is laterally insertable; and a closure plate axially slidable onto said cover cap to secure said socket contact housing within said cover cap.

16. The electrical connector according to claim 15 further comprising:

guide channels in said socket contact housing; and guide ribs on said cover cap engageable with said guide channels upon insertion of said socket contact housing into said cover cap, whereby said socket contacts are also thereby secured.

17. The electrical connector according to claim 9 further comprising:

a cross web disposed in said pin plug which secures said first socket contacts in said pin plug.

18. An electrical connector for comprising:

a pin plug having a plurality of electrically conductive pin contacts, said pin contacts connectable to system wires via electrically conductive first socket contacts;

a socket plug matably coupleable with said pin plug, said socket plug having a plurality of electrically conductive second socket contacts engageable with said pin contacts;

an electrical filter component disposed within said pin plug, said filter component being series connected between a one of said system wires and one of said pins;

a short-circuit bridge in said socket plug which causes a short-circuit between two said second socket contacts when said pin plug and said socket plug are not coupled; and a tongue element disposed on said pin plug which deflects said short-circuit bridge when said pin plug and socket plug are coupled, canceling said short circuit.

19. The electrical connector according to claim 18 wherein said pin plug is shaped generally cylindrically, said pin plug comprising:

a face side at one end of said pin plug, said face side having an opening configured to receive said socket plug during coupling;

a cable outlet side at an end opposite said face side;

a first chamber shaped generally half-cylindrically near said wiring cable outlet side to receive said component;

a second chamber shaped generally half-cylindrically near said cable outlet side to house said first socket contacts;

a first closure cover to close said first chamber; and a second closure cover to close said second chamber.

* * * * *